United States Patent [19]

Heina

[11] 4,402,679

[45] Sep. 6, 1983

[54] SHEET DEFLECTOR FOR NOISE REDUCTION IN MULTI-STAGE FOLDING MACHINES

[75] Inventor: Fritz Heina, Murrhardt, Fed. Rep. of Germany

[73] Assignee: Maschinenbau Oppenweiler Binder GmbH & Co., Fed. Rep. of Germany

[21] Appl. No.: 316,850

[22] Filed: Oct. 30, 1981

[51] Int. Cl.[3] ..... B65H 45/14

[52] U.S. Cl. ..... 493/420

[58] Field of Search ..... 493/419–421

[56] References Cited

FOREIGN PATENT DOCUMENTS 391549 5/1933 United Kingdom ..... 493/421

*Primary Examiner*—A. J. Heinz

*Attorney, Agent, or Firm*—Harding, Earley

[57] ABSTRACT

A sheet deflector for noise reduction in multi-stage folding machines having first and second folding rollers (1,3) with a clearance space (5) between them, with said space (5) being in the path of a sheet (8) to be folded, comprising a sheet deflector (4) having a curved guide surface (20) for deflecting the sheet, at least one slot-shaped opening in the sheet deflector (4) extending toward the bottom of said curved guide surface (20) and extending towards an intake opening (7) between a third folding roller (2) and the second folding roller (3) and a blade-shaped slide (12) which can be horizontally moved out of said slot-shaped opening towards the intake roller opening (7) when the sheet deflector (4) is inserted between said first and second rollers (1,3), whereby the blade-shaped slide (12) is adapted to guide the sheet so that it is folded exactly and faultlessly with very little noise into the bite between first and second rollers (1,3).

6 Claims, 3 Drawing Figures

SHEET DEFLECTOR FOR NOISE REDUCTION IN MULTI-STAGE FOLDING MACHINES

Figure 1:
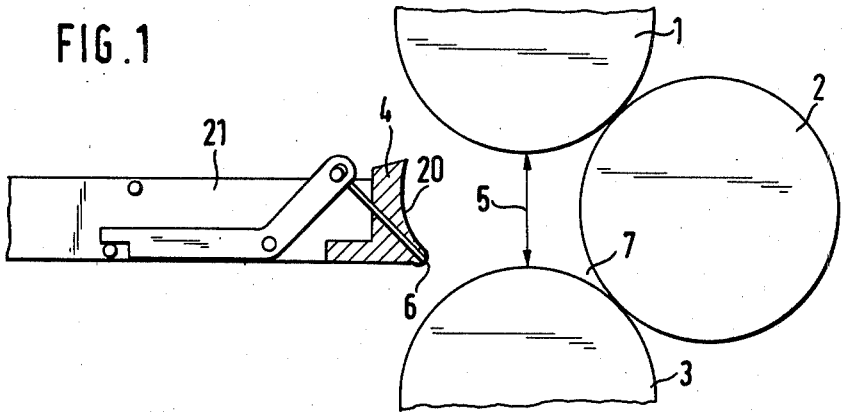

The invention concerns a sheet deflector to reduce noise in multiple stage folding machines, which deflector can be inserted against the intake direction of the sheet to be folded into the clearance between the two folding rollers located one above the other, and which has a curved guide surface in the deflection direction of the sheet.

It is a known procedure in conjunction with the performance of various folding processes in a multi-stage folding machine to provide so-called blind pockets or sheet deflectors which can be removed or inserted according to the desired folding process. Usually, they are inserted into the clearance between two folding rollers located one above the other, against the intake direction of the sheet to be folded. The sheet deflector has a guide surface which is curved in the deflection direction towards the intake opening of the subsequent pair of rollers. A sheet running in through the first pair of rollers will arrive at the guide surface and will be deflected thereby towards the intake opening of the subsequent pair for folding rollers. The sound generated when the sheet hits the guide surface can be reduced if the sheet deflector is held in its position by means of a layer of a material that dampens the sound conduction (DE-OS No. 23 61 803).

The range of the curved surface of the sheet deflector is limited by the distance between the folding rollers located one above the other. Since the insertion of the sheet deflector into this clearance between the folding rollers located one above the other must be guaranteed, the exit end will be located relatively far from the entry clearance between the rollers, so that the sheet is not guided directly into the intake opening between the rollers but first hits the folding roller below the sheet deflector. By the push of the pair of folding rollers feeding the sheet forward, and by the rotating movement of the folding roller below it, which moves the sheet forwards together with one of the folding rollers of the intake roller pair, the sheet is brought into the opening between the intake rollers. At the impact of the front edge of the sheet in the direction of travel onto the folding roller this /edge/ may be damaged, if the paper is soft, or /it may / receive a double fold. Furthermore, investigations have shown that this impact causes significant noise.

thus, the problem to be solved by the invention consists in developing a sheet deflector of the initially cited nature in such a manner that when the front end of the sheet hits the next roller on the deflector side, the noise generated thereby will be avoided and a faultless and low-nose entry into the intake roller opening is guaranteed.

In the case of the sheet deflector of the initially mentioned nature, this problem is solved therein that there is at least one axially oriented, slot-shaped opening towards the exit end of the guide surface and oriented towards the intake opening formed by the next folding roller pair, and through which a blade-shaped slide can be horizontally moved from the inserted position of the sheet deflector towards the intake opening between the rollers.

Preferably, the sheet deflector has a catching rocker-arm device for moving the slide, which device is located on the side facing the slide. The movement of the rocker arm can be limited by means of buffers. The slide can be manufactured of spring band steel or can be designed as a brush.

The sheet deflector according to the invention has the advantage that when the slide is moved, which may be achieved manually, by means of an electromagnet, or by means of a cam control, the exit end of the sheet deflector in its working position can be exactly positioned and feed into the intake roller opening of the adjacent folding roller pair, as determined by the distance of the folding rollers located one above the other. Thereby, the impact of the sheet on the folding roller is eliminated, so that damage to the leading edge of the paper can be avoided and the folding machine can be operated at a low noise level. Test measurements have shown that the sheet deflector according to the invention can achieve a reduction of folding machine noise in the range from 4 to 6 dB (A).

Figure 2:
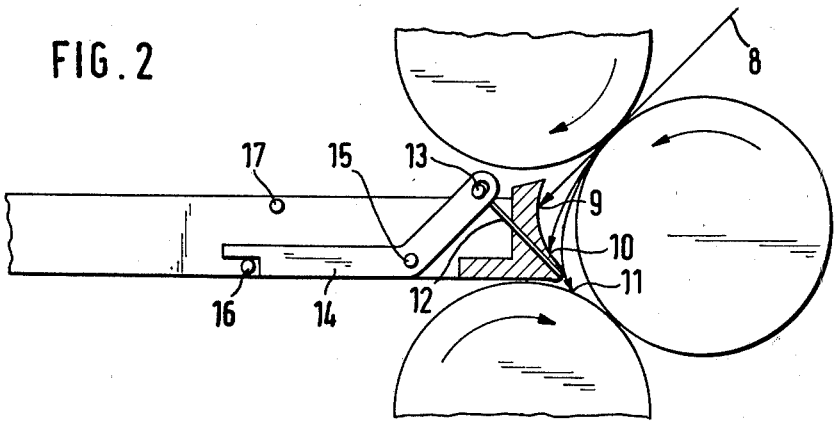
Figure 3:
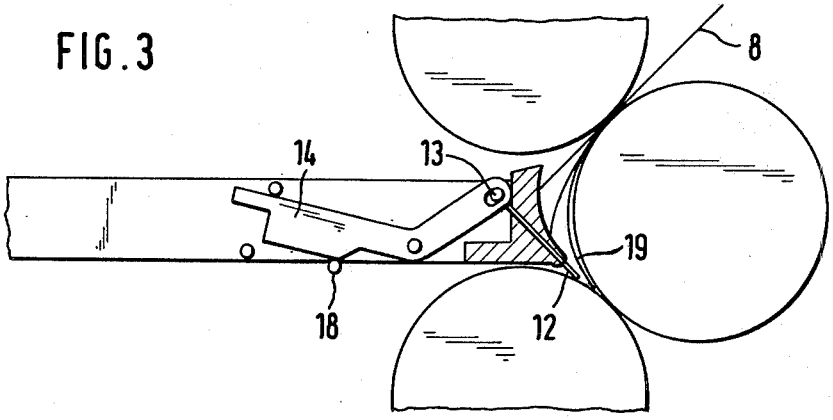

The invention is explained in greater detail by means of an example and with reference to the drawing. The figures show the following:

FIG. 1—schematically, in a partially cut-away side view, a sheet deflector in its retracted position;

FIG. 2—the same view as in FIG. 1, but with the sheet deflector in its inserted position; and FIG. 3—the same view as in FIG. 2, in the inserted position with horizontally drawn out slide.

In the folding machine shown in FIGS. 1 through 3, a sheet 8 is fed between the rollers 1 and 2. The sheet is to be guided into the intake roller opening 7 of the folding rollers 2 and 3 by means of a sheet deflector 4, whereby the folding roller 3 is located at the distance 5 (FIG. 1) below the folding roller 1. The distance 5 determines the possible overall height of the sheet deflector 4.

The sheet deflector 4 is inserted horizontally into the space between the folding rollers 1, 2, and 3 by means of a carrier 21. As shown in FIG. 2, the sheet 8, which is fed between the folding rollers 1 and 2, hits the guide surface 20 of the sheet deflector 4 at point 9 and is guided to point 10 while being curved. Pushed out over the exit end 6 of the sheet deflector 4, the sheet 8 first hits the folding roller 3 at the point 11, and not until then will it be guided by the folding roller 3 into the intake roller opening 7 between the folding rollers 2 and 3. This impact of the sheet 8 with its leading edge onto point 11 increases the noise level of the machine significantly. When soft paper is used, the leading edge of the sheet 8 may be damaged or bent when impacting on the folding roller 3 at point 11, subsequently resulting in an undesirable double fold.

In order to avoid this, at least one slot-shaped opening is provided in the sheet deflector 4, leading to the exit end 6 of the sheet deflector 4 and oriented in such a way that it buts against the end of the guide surface 20 in a basically tangential manner. In the slot-shaped opening, a slide 12 is located, which consists of flat steel plate, preferably spring band steel, or developed as a brush. At the end facing the intake roller opening 7, there is a bolt 13 on the blade-shaped slide 12, which bolt is moved in an oblong hole in a rocker arm device 14, consisting of two arms leaning towards each other and having, at that point where the arms are connected with each other, a swivel 15, which is attached to the carrier 21.

In the working position shown in FIG. 2, that arm of the rocker arm device 14 which catches the bolt 13 in the oblong hole has an orientation which is basically vertical to the slide 12, while the other arm of the rocker arm device 14 is horizontal. The free end of this arm will then rest on a lower buffer 16.

To horizontally move the slide 12 into the deflection position shown in FIG. 3, the rocker arm device 14 is pivoted until it meets an upper buffer 17, which movement may be achieved manually, by means of an electromagnet, or by means of a schematically shown activating cam 18, for which a corresponding running surface is provided on the rocker arm device 14. Through this swivel movement of the rocker arm device 14 around the pivot 15, the slide 12 is drawn out from the intake end 6 of the sheet deflector into the intake roller opening 7 in such a manner that the sheet leaving the guide surface 20 of the sheet deflector 4 is moved on the slide 12 as on an extension of said guide surface /and arrives/ exactly between the folding rollers 2 and 3.

When the sheet deflector 4 is to be removed from the space determined by the distance 5 between the folding rollers 1, 2, and 3, the rocker arm device 14 is first drawn into the position shown in FIG. 2, by turning the rocker arm device 14 and thereby moving the slide 12 so far that its free end is located in the area of the exit end 6 of the sheet deflector 4 or within the sheet deflector 4. By means of the carrier 21, the sheet deflector 4 can then be pulled out horizontally from the space between the folding rollers 1, 2, and 3 without difficulty.

Depending on the length of the folding roller, several longitudinally distributed slot-shaped openings can be provided in the sheet deflector 4, in which tongue-shaped slides 12 can be located and can then, in turn, be pulled out into the work position or retracted again into the neutral position by means of a rod replacing the bolt 13 and connecting the slide ends with the rocker arm device 14 or another suitable activation mechanism.

I claim:

1. Sheet deflector for noise reduction in multi-stage folding machines having first and second folding rollers (1,3) with a clearance space (5) between them, with said space (5) being in the path of a sheet (8) to be folded, a third roller tangentially positioned adjacent said first and second rollers wherein said clearance space is bracketed by the three rollers, comprising a sheet deflector (4) insertable between said first and second rollers and having a curved guide surface (20) approximating the curvature of and facing the third roller for deflecting the sheet about the third roller, at least one slot-shaped opening in the sheet deflector (4) extending in a direction toward a nip region between said second (3) and third folding rollers (2) and a blade-shaped slide (12) which can be moved through and guided by said slot-shaped opening to project beyond the curved guide surface towards the nip region when the sheet deflector (4) is inserted between said first and second rollers (1,3).

2. Sheet deflector according to claim 1, including a rocker arm device (14) engaging the end of the slide (12) away from the bottom of the slot-shaped opening, and designed to generate horizontal movement of the slide (12).

3. Sheet deflector according to claim 2, including buffers (16,17) to limit the movement of the rocker arm device (14).

4. Sheet deflector according to claim 2 or 3, including an activation cam (18) engaging the rocker arm device (14).

5. Sheet deflector according to claim 1, wherein the slide (12) comprises spring band steel.

6. Sheet deflector according to claim 1, wherein the slide (12) is a brush.

* * * * *